United States Patent [19]

Curtis et al.

[11] Patent Number: 4,535,390

[45] Date of Patent: Aug. 13, 1985

[54] FOLDING REFLECTOR FOR A LANTERN

[75] Inventors: Richard D. Curtis; James R. Conley, both of Wichita, Kans.

[73] Assignee: The Coleman Company, Inc., Wichita, Kans.

[21] Appl. No.: 623,834

[22] Filed: Jun. 22, 1984

[51] Int. Cl.[3] ..... F21L 19/00

[52] U.S. Cl. ..... 362/179; 362/159; 362/166; 362/181; 362/182; 362/255; 362/278; 362/297; 362/319; 362/320; 362/346; 362/347

[58] Field of Search ..... 362/159, 166, 179, 181, 362/182, 346, 278, 255, 297, 347, 319, 320

[56] References Cited

U.S. PATENT DOCUMENTS 4,172,275 10/1979 Caverio ..... 362/159

*Primary Examiner*—Stephen J. Lechert, Jr.

[57] ABSTRACT

A folding reflector for a lantern is formed from a pair of reflecting panels which are pivotally secured for pivotal movement between a folded position in which the panels are superposed and an extended position in which the panels extend in opposite directions from the pivot. When the panels are extended, the reflector can be inserted around the globe of the lantern. When the panels are folded, the reflector can be stored in the bottom of the fount of the lantern.

14 Claims, 6 Drawing Figures

FOLDING REFLECTOR FOR A LANTERN

BACKGROUND AND SUMMARY

This invention relates to lanterns, and, more particularly, to folding reflector for a lantern.

Lanterns such as gasoline lanterns conventionally include a fuel fount and a globe above the fount which encloses the light source, typically a mantle. The globe is commonly positioned within a frame or cage which is formed by vertically extending bands or rods.

At times it is desired to reflect the light from the lantern so that the light is concentrated in one direction or is shielded from another direction. It is known to use a sheet metal reflector which can fit between the globe and the frame. However, prior art reflectors are one piece and are therefore bulky and difficult to store when not being used.

The invention provides a folding reflector which can be folded into a compact configuration and stored in the bottom of the fount. The reflector is formed from a pair of reflecting panels which are pivotally secured for pivoting movement between the folded position and an unfolded or extended position. When the reflector is unfolded, it can be inserted between the lantern frame and the globe. The panels are made from deformable and resilient sheet metal, and they will assume the curved shape of the globe. When the reflector is removed from the lantern, the panels will return to a generally flat configuration for storage.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
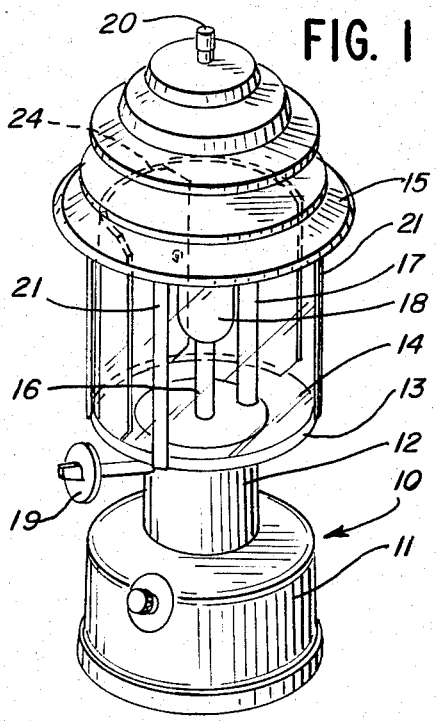
FIG. 1 is a perspective view of a gasoline lantern equipped with a folding reflector in accordance with the invention.

Referring to FIG. 1, the numeral 10 designates a conventional gasoline lantern which includes a fuel fount 11, a collar 12 above the fount, a base plate 13 which is supported by the collar, a cylindrical globe 14 which is supported by the base plate, and a top 15 which covers the top of the globe.

The lantern includes a conventional burner assembly which is enclosed by the globe 14 and which includes a generator tube 16, an air tube 17, and a mantle 18. Flow of fuel from the fount 11 to the generator tube is controlled by a fuel control assembly within the collar 12 which is operated by a knob 19. The top 15 is secured to the upper end of the burner assembly by a nut 20 which is screwed onto a stud which extends upwardly from the burner assembly.

A frame or cage for the globe is provided by a plurality of retainer bands 21 which are secured to the base plate 13 and extend upwardly therefrom. The bands are spaced about 90° apart, and the upper ends of the bands are secured to a ring which surrounds the top of the globe.

The foregoing lantern is conventional, and the details of the various parts of the lantern are explained, for example, in U.S. Pat. Nos. 2,263,659, 3,529,911, and Reissue No. 29,457.

A reflector 24 is positioned between the retainer bands 21 and the globe 14 and extends around about one-half of the circumference of the globe. The reflector can be inserted between the bands and the globe by unscrewing the nut 20 and removing the top 15.

Figure 3:
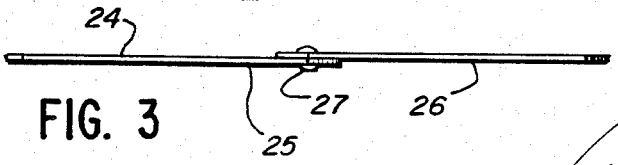
FIG. 3 is a top plan view of the unfolded reflector.
Figure 4:
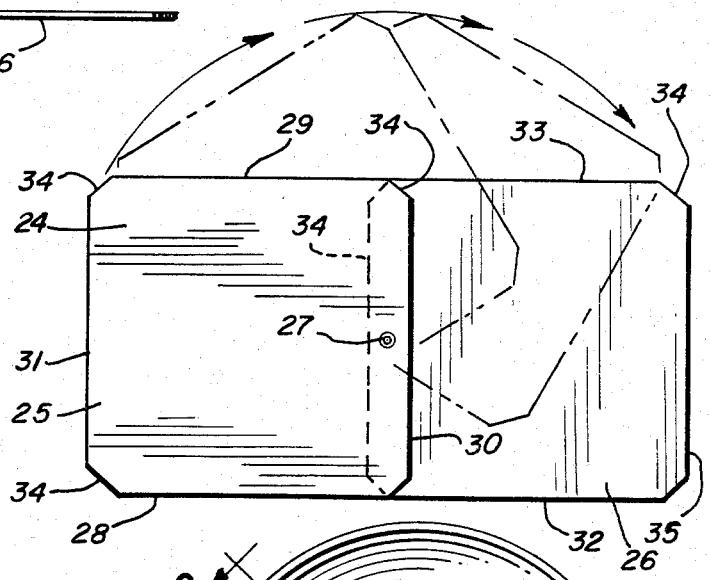
FIG. 4 is an elevational view of the unfolded reflector with the folding movement of the reflector shown in phantom.

Referring to FIGS. 3 and 4, the reflector 24 is formed from a pair of rectangular panels 25 and 26 which are pivotally secured together by a rivet or pin 27. The panel 25 includes a pair of parallel side edges 28 and 29 and a pair of parallel end edges 30 and 31. Similarly, the panel 26 includes a pair of parallel side edges 32 and 33 and a pair of parallel end edges 34 and 35. The panels are secured by the rivet 27 adjacent the end edges 30 and 34.

FIG. 4 shows the reflector in its unfolded or extended position in which the panels 25 and 26 extend in opposite directions from the rivet 27 and all of the side edges 28, 29, 32, and 33 are parallel. Each corner of the panels is beveled or mitered as indicated at 34.

Figure 5:
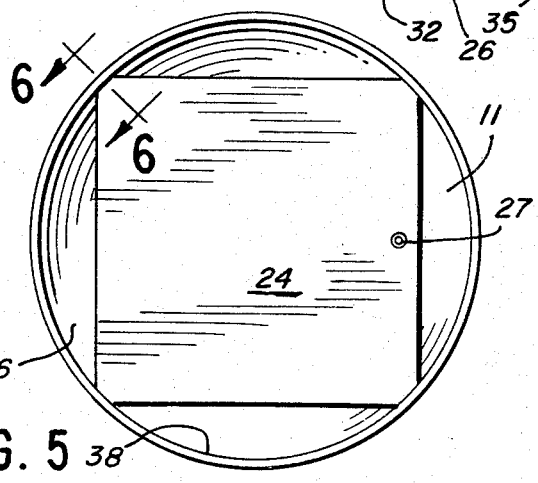
FIG. 5 is a bottom plan view of the lantern with the folded reflector stored in the bottom of the fount.

As illustrated in the dotted outline in FIG. 4, the panels can be folded or pivoted about the rivet 27 so that the panels are superposed as shown in FIG. 5. In the particular embodiment illustrated, the panels are squares of the same size, and when the panels are superposed, the side and end edges and the beveled corners of the panels will be aligned.

Figure 6:
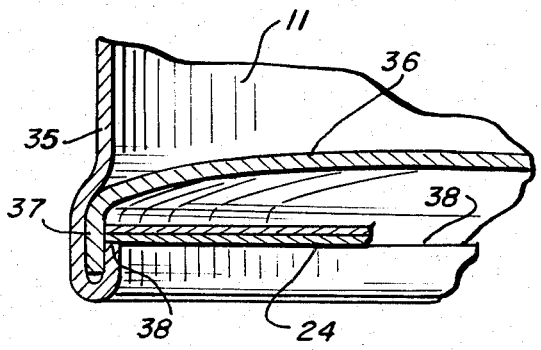
FIG. 6 is an enlarged fragmentary sectional view taken along the line 6—6 of FIG. 5.

Referring to FIG. 6, the fount is formed from a generally cylindrical side wall 35 and a somewhat dome-shaped bottom wall 36 which terminates in a cylindrical side flange 37. The bottom of the side wall 35 is turned upwardly over the bottom of the flange 37 and suitably secured, as by spotwelding, crimping, or the like. The upturned bottom edge of the side wall 35 forms an annular shoulder 38.

Figure 2:
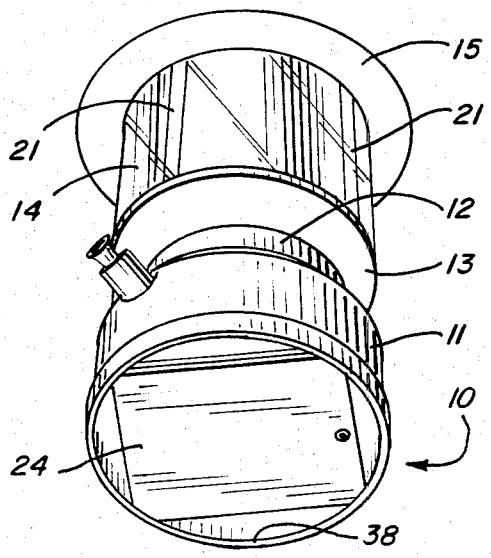
FIG. 2 is a perspective view of the lantern showing the folded reflector stored in the bottom of the fount.

When the reflector is in its folded position in which the panels are superposed, the reflector can be stored in the bottom of the fount by inserting the corners of the folded panels above the shoulder 38 as shown in FIGS. 2, 6, and 7. The panels are sized relative to the shoulder 38 to permit the panels to be inserted above and retained by the shoulders, and the beveled corners of the panels permit the corners to more closely approximate the circular shape of the shoulder.

The panels are preferably made from a deformable and resilient sheet metal such as aluminum. In one specific embodiment, the panels were made from 0.008 inch thick 2024 T-3 Alclad aluminum sheet.

The deformability of the panels permits the panels to be flexed and snapped into position above the shoulder 38. After the panels have been snapped in place, the resilient panels will return to a generally flat configuration.

The deformability of the panels also permits the unfolded reflector to assume the curved configuration of the globe when the reflector is inserted between the globe and the bands 21. The reflector is retained in the curved configuration by the bands, and the curved reflector will reflect light from the mantle in a generally parallel path. When the reflector is removed from the lantern, the resilient panels will return to a generally flat configuration.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. A folding reflector for a lantern having a fuel fount, a light source above the fuel fount, and a globe surrounding the light source, the reflector comprising a pair of reflecting panels and means for pivotally securing the panels for pivoting movement about an axis which extends perpendicularly to the panels so that the panels may be pivoted between a folded position in which the panels are superposed and an extended position in which the panels extend in opposite directions from the securing means and in which the panels can extend around a portion of the globe.

2. The reflector of claim 1 in which each of the panels is generally rectangular and has a pair of side edges and a pair of end edges, each of the panels being pivotally secured to the other panel adjacent one of the end edges, the side edges of the panels extending parallel to each other in both the folded position and the extended position.

3. The reflector of claim 2 in which the panels are the same size.

4. The reflector of claim 1 in which the panels are formed from resilient, deformable material so that the panels can be deformed into a curved shape around the globe and will return to a substantially flat configuration when the panels are removed from the globe.

5. The reflector of claim 4 in which the panels are formed from aluminum sheet.

6. The reflector of claim 1 in which the panels are sized to fit underneath the fount when the panels are in the folded position.

7. The reflector of claim 1 in which the fount includes a circular shoulder inside the bottom of the fount, each of the panels being generally rectangular and having a pair of side edges and a pair of end edges, each of the panels being pivotally secured to the other panel adjacent one of the end edges, the side edges of the panels extending parallel to each other in both the folded position and the extended position, the reflector having four outside corners when the panels are in the folded position, each of the corners being beveled so that the folded reflector can be inserted inside the bottom of the fount above the shoulder.

8. The reflector of claim 7 in which the panels are the same size and all of the corners of the panels are beveled.

9. The reflector of claim 7 in which the panels are formed from resilient, deformable material so that the panels can be deformed into a curved shape around the globe and will return to a substantially flat configuration when the panels are removed from the globe.

10. The reflector of claim 9 in which the panels are formed from aluminum sheet.

11. In combination, a lantern and a folding reflector for the lantern, the lantern having a fuel fount, a light source above the fuel fount, and a globe surrounding the light source, the fount including a circular shoulder inside the bottom of the fount, the reflector comprising a pair of reflecting panels and means for pivotally securing the panels for pivoting movement about an axis which extends perpendicularly to the panels so that the panels may be pivoted between a folded position in which the panels extend in opposite direction from the securing means and in which the panels can extend around a portion of the globe, the panels being sized to fit underneath the fount above the shoulder thereof when the panels are in the folded position.

12. The structure of claim 11 in which the reflector has four outside corners when the panels are in the folded position, each of the corners being beveled so that the folded reflector can be inserted inside the bottom of the fount above the shoulder.

13. The combination of claim 11 in which each of the panels is generally rectangular and has a pair of side edges and a pair of end edges, each of the panels being pivotally secured to the other panel adjacent one of the end edges, the side edges of the panels extending parallel to each other in both the folded position and the extended position.

14. The structure of claim 11 in which the panels are formed from resilient, deformable material so that the panels can be deformed into a curved shape around the globe and will return to a substantially flat configuration when the panels are removed from the globe.

* * * * *